US005791359A

United States Patent [19]

Lin et al.

[11] Patent Number: 5,791,359

[45] Date of Patent: Aug. 11, 1998

[54] LIGHTENING MULTIPLE-FOLD AUTOMATIC UMBRELLA

[75] Inventors: Chung-Kuang Lin; Jung-Jen Chang, both of Taipei Hsien, Taiwan

[73] Assignee: Fu Tai Umbrella Works, Ltd., Taipei Hsien, Taiwan

[21] Appl. No.: 917,601

[22] Filed: Aug. 26, 1997

[51] Int. Cl.[6] ..... A45B 25/14

[52] U.S. Cl. ..... 135/24; 135/22; 135/28

[58] Field of Search ..... 135/22, 24, 25.1, 135/25.4, 28, 20.3, 25.41, 38, 39, 40, 41

[56] References Cited

U.S. PATENT DOCUMENTS

| | | | |
|---|---|---|---|
| 4,823,821 | 4/1989 | Day | 135/24 |
| 4,825,888 | 5/1989 | Su | 135/22 |
| 5,232,004 | 8/1993 | Wu . | |
| 5,309,932 | 5/1994 | Chou et al. | 135/22 |
| 5,390,686 | 2/1995 | Lin et al. . | |
| 5,441,065 | 8/1995 | Lin et al. . | |
| 5,492,140 | 2/1996 | Lin et al. . | |
| 5,626,161 | 5/1997 | Lin et al. . | |
| 5,645,094 | 7/1997 | Wu . | |
| 5,720,311 | 2/1998 | Lin et al. . | |

*Primary Examiner*—Lanna Mai

[57] ABSTRACT

An automatic umbrella includes: a central shaft (1) having a lower tube (11), a middle tube (13) and an upper tube (14) telescopically engageable with one another, an umbrella rib assembly (2) pivotally secured to the central shaft (1) and having an umbrella cloth (C) secured on the rib assembly (2), an opening spring (3) retained in the central shaft (1) for automatically opening the umbrella, a drag means (4) provided in the central shaft (1) through a lower runner (24) of the rib assembly (2) for pulling the lower runner (24) upwardly for extending the rib assembly (2) when opening the umbrella, and a control means (5) for controlling the automatic opening of the umbrella, wherein the tubes of the central shaft (1) are each made of light weight materials for lightening the weight of the umbrella and each tube having a cross section of concave hexagonal sides for reinforcing the strength of the tubes of the central shaft for a reliable umbrella opening operation.

1 Claim, 5 Drawing Sheets

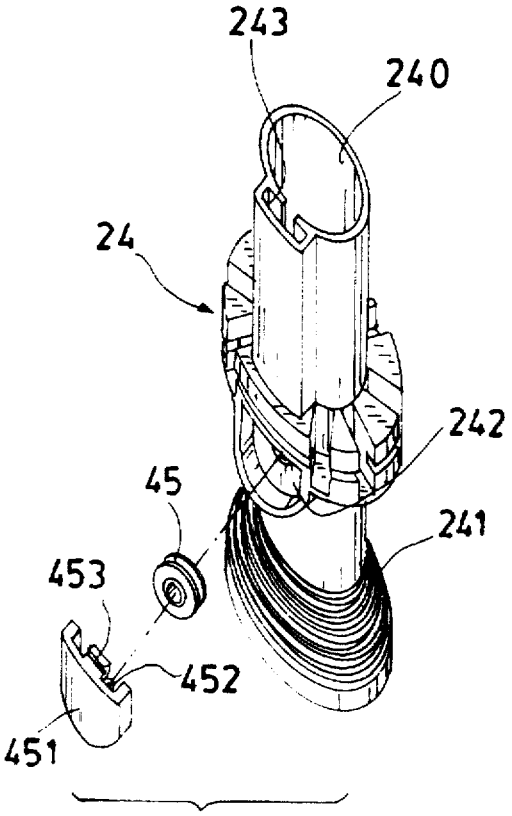
FIG. 12
FIG. 13
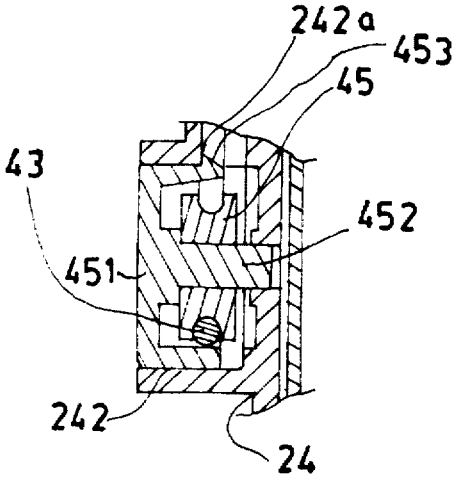
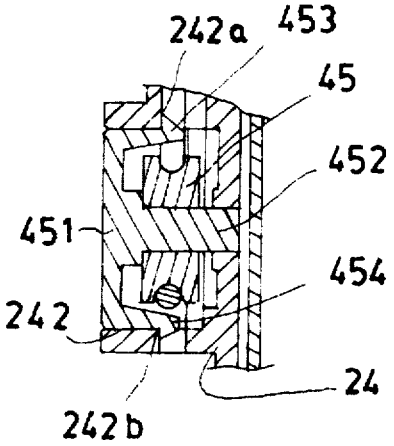
FIG. 14
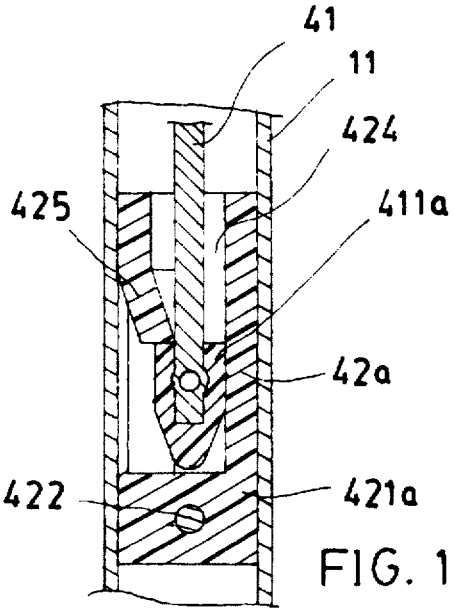
FIG. 15

LIGHTENING MULTIPLE-FOLD AUTOMATIC UMBRELLA

BACKGROUND OF THE INVENTION

A conventional automatic umbrella having triple folds as shown in FIG. 1 includes: a lower tube T1, a middle tube T2 and an upper tube T3 telescopically engageable with one another to form a central shaft; an umbrella rib asssembly R pivotally secured to the central shaft and secured to a lower runner L and a middle runner M; an upper spring S1 and a lower spring S2 retained in the central shaft for extending the tubes T3, T2, T1 when opening the umbrella; a tension spring S3 retained between the lower runner L and the middle runner M for extending the rib assembly R for opening the umbrella; and a button B slidably held in a grip and depressed for opening the umbrella by disengaging the hook H from the middle and upper tubes T2, T3 as previously folded on the lower tube T1 when the umbrella was closed.

However, such a conventional triple-fold automatic umbrella has the following drawbacks:

1. The elastic force of the springs S1, S2 in the central shaft is very strong to rapidly extend the tubes T3, T2, T1, even faster than the extending of the rib assembly R as urged by the tension spring S3, to possibly injure the umbrella user.

2. The strong force of the springs S1, S2 may damage the joints of the tubes having spring catches C1, C2 provided respectively at the joints.

3. For connecting or retaining the upper spring S1 and the lower spring S2 within the central shaft, a plug P and a retainer U should be provided between the two springs S1, S2 adjacent to the catch C2, thereby increasing the assembly complexity and production inconvenience when making the umbrella.

4. In order to sustain the great spring force of the springs S1, S2, the tubes T3, T2, T1 should be made of thick steel tubes to increase the umbrella weight and cause carrying inconvenience. If the steel tubes are inferentially replaced by light aluminum alloy, the aluminum tubes will be easily deformed, twisted or even broken to damage the umbrella.

The, present inventor has found the drawbacks of the conventional automatic umbrella and invented the present automatic umbrella with a light weight and reliable operation.

SUMMARY OF THE INVENTION

The object of the present invention is to provide a lightening multiple-fold automatic umbrella including: a central shaft having a lower tube, a middle tube and an upper tube telescopically engageable with one another, an umbrella rib assembly pivotally secured to the central shaft and having an umbrella cloth secured on the rib assembly, an opening spring retained in the central shaft for automatically opening the umbrella, a drag means provided in the central shaft through a lower runner of the rib assembly for pulling the lower runner upwardly for extending the rib assembly when opening the umbrella, and a control means for controlling the automatic opening of the umbrella, wherein the tubes of the central shaft are each made of light weight materials such as aluminum alloy for lightening the weight of the umbrella and each tube having a cross section of concave hexagonal sides for reinforcing the strength of the tubes of the central shaft for a reliable umbrella opening operation.

BRIEF DESCRIPTION OF THE DRAWINGS

FIG. 12 is a perspective view of the lower runner of the present invention.

FIG. 13 is a sectional drawing of the roller holder fixed into the lower runner as assembled from FIG. 12.

FIG. 14 shows another fixation of the roller holder in the lower runner.

FIG. 15 shows another preferred embodiment of the link and the link holder as modified from that as shown in FIGS. 7–9.

DETAILED DESCRIPTION

Figure 1:
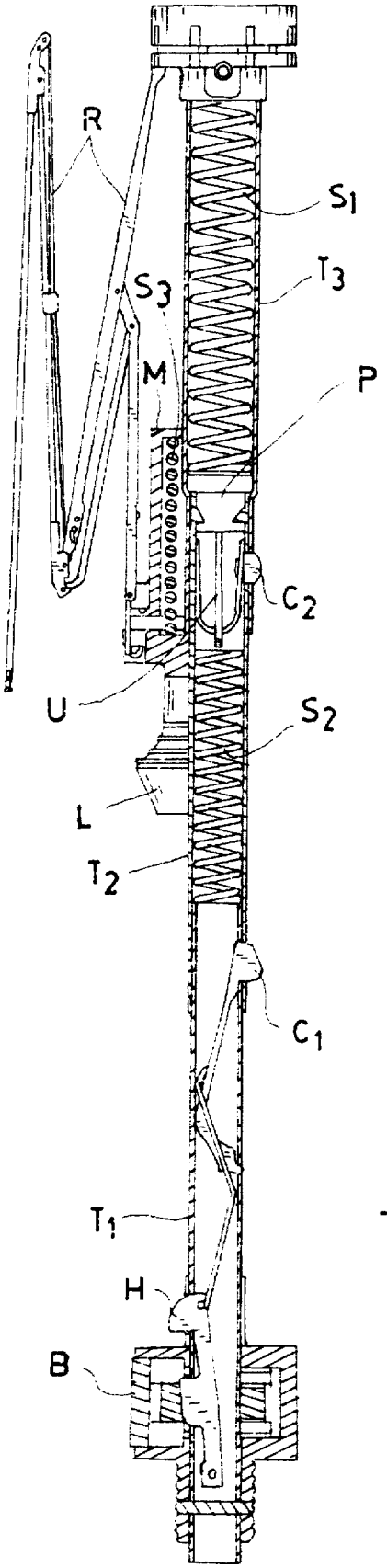
FIG. 1 PRIOR ART
FIG. 1 is a sectional drawing of a conventional automatic umbrella having triple folds.

As shown in FIGS. 2–14, the present invention comprises: a central shaft 1, an umbrella rib assembly 2, an opening spring 3, a drag means 4, and a control means 5.

The present invention may be provided for triple folds automatic umbrella. Naturally, the present invention may also be used for two-folds umbrella, not limited in the present invention.

The central shaft 1 includes: a lower tube 11 having a grip 12 secured under the lower tube 11, a middle tube 13 telescopically engaged with the lower tube 11, an upper tube 14 telescopically engaged with the middle tube 13, and an inner block 15 fixed in an upper end portion of the upper tube 14.

Figure 5:
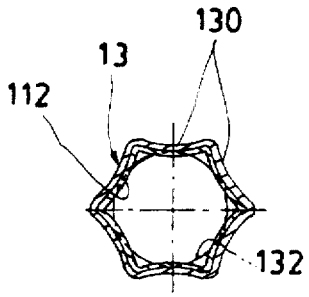
FIG. 5 is a cross sectional drawing when viewed from 5—5 direction of FIG. 4.
Figure 6:
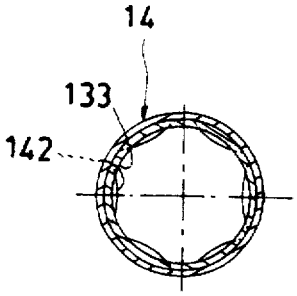
FIG. 6 is a cross sectional drawing when viewed from 6—6 direction of FIG. 4.
Figure 11:
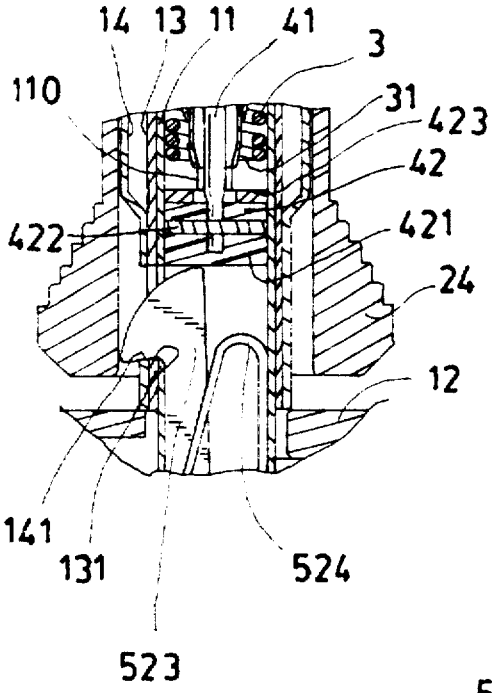
FIG. 11 is a partial enlarged view from FIG. 10 of the present invention.

The middle tube 13 especially as shown in FIG. 5 has a cross section of concave hexagonal sides 130, having a lower tube portion of the middle tube 13 slidably engageable with an upper tube end 112 of the lower tube 11 and having a cross section of concave hexagonal sides, and having a lowermost tube end 132 of the middle tube 13 contracted to form a cylindrical tube 132 to be engageable with the lower tube 11 having a cross section of circular shape below the upper tube end 112, and having an upper tube end 133 of the middle tube 13 slightly enlarged to form a cylindrical tube to be slidably engageable with the upper tube 14.

The upper tube 14 has a lower tube end 142 having a cross section of concave hexagonal sides to be slidably engageable with an upper tube portion of the middle tube 13 having a cross section of concave hexagonal sides, having an engaging hole 141 formed in the lower tube end 142, and having an upper end 143 of the upper tube 14 secured with an upper notch 22 of the umbrella rib assembly 2.

The umbrella rib assembly 2 includes: at least a top rib 21 pivotally secured to the upper notch 22, a stretcher rib 23 pivotally connected between the top rib 21 and a lower runner 24 slidably held on the central shaft 1, a middle rib 25 having an inner rib end connected to the stretcher rib 23 by means of a middle connecting rib 26 and also pivotally connected to the top rib 21 and having an outer rib end of the middle rib 25 pivotally connected with an outer rib 27 which is also connected to the top rib 21 by means of a resilient rib 28. The rib assembly 2 is provided for fixing an umbrella cloth C thereon and may be modified for any multiple-fold umbrellas.

The lower runner 24 as shown in FIG. 12 includes: a short sleeve 24 slidably held on the central shaft 1, a skirt portion 241 gradationally enlarged outwardly downwardly from the short sleeve 24 for pulling the skirt portion 241 downwardly when closing the umbrella, a socket 242 recessed in a middle portion of the lower runner 24 for embedding a roller holder 451 in the socket 242 for rotatably mounting a lower roller 45 in the roller holder 451, and a rope groove 243 longitudinally formed in the lower runner 24 for passing a rope 43 of the drag means 4 through the rope groove 243 to be wound on the lower roller 45 on the roller holder 451.

The opening spring 3 is a single elongate spring having a lower spring end 31 retained in a lower tube portion of the lower tube 11 and having an upper spring end 32 retained against the inner block 15 at the upper end portion of the upper tube 14.

The tubes of the central shaft 1 may also be formed as hexagonal shape. The designation of this invention as "automatic" umbrella is due to an automatic opening of the umbrella by the opening spring 3. For closing the umbrella it should be manually done such as by lowering the runner 24 for retracting the ribs 2 and folding the tubes by the user. Hence, it is critically a semi-automatic umbrella.

Figures 2, 7, 8, 9:
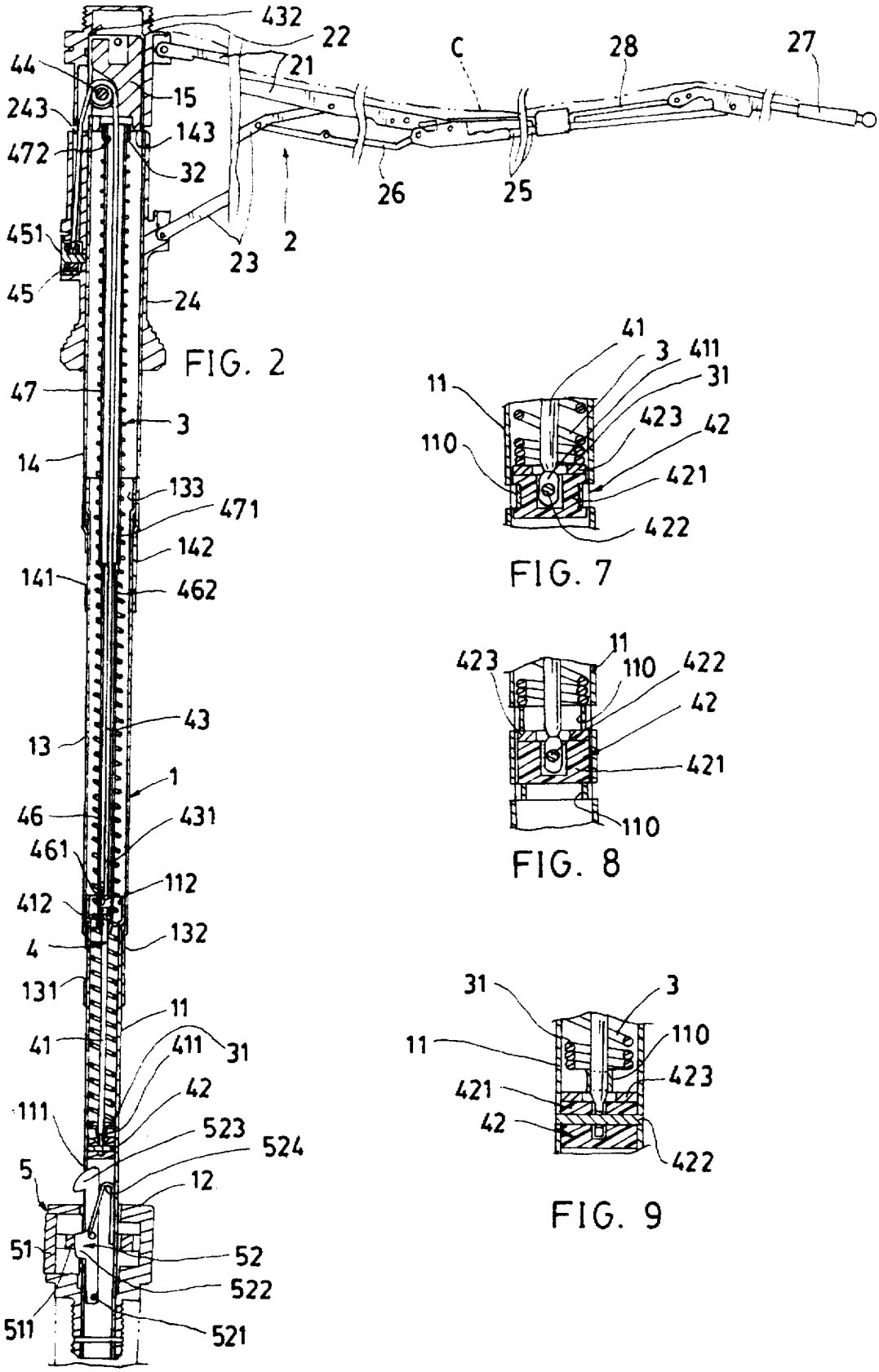
FIG. 2 is an illustration showing an opening umbrella of the present invention.
FIG. 7 is an illustration showing the assembly relationship between a link and a link holder of the drag means of the present invention.
FIG. 8 shows another preferred embodiment of the link and the link holder of the present invention.
FIG. 9 shows still another preferred assembly of the link and the link holder.
Figure 3:
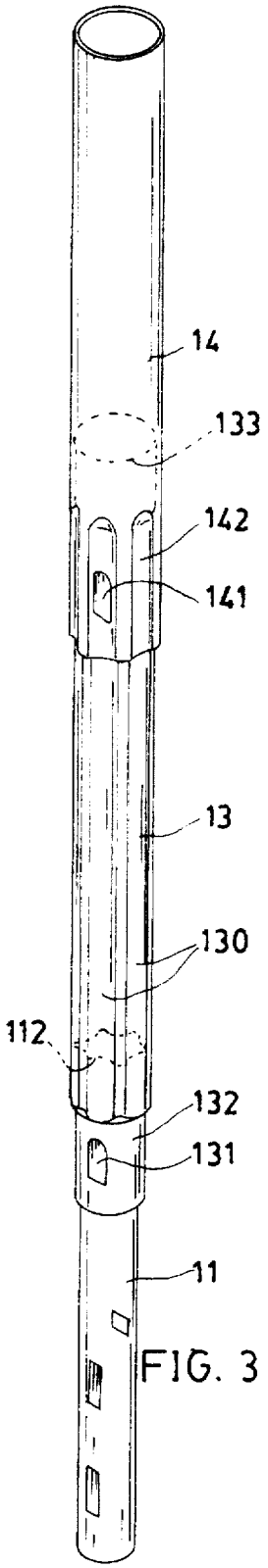
FIG. 3 is a perspective view of the upper, middle and lower tubes telescopically engaged for forming the central shaft of the present invention.
Figure 4:
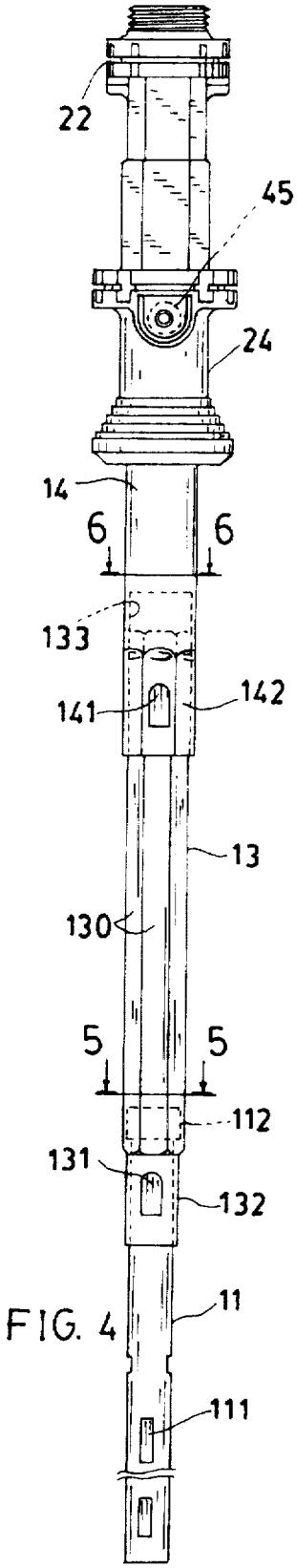
FIG. 4 is an illustration when assembling the upper, the middle and the lower tubes of the central shaft of the present invention.

The drag means 4 includes: a link 41 having a lower link end 411 secured on a link holder 42 fixed in a lower portion of the lower tube 11, a rope 43 having a lower rope end 431 connected with an upper link end 412 of the link 41 and having an upper rope end 432 fixed into the inner block 15 on the upper tube 14 by winding the rope 43 through an upper roller 44 rotatably mounted on the inner block 15 and then deflected downwardly to be wound on the lower roller 45 rotatably mounted on the lower runner 24 and then to be terminated at the upper rope end 432, a middle sleeve 46 having a lower sleeve end 461 disposed around a joint between the upper link end 412 of the link 41 and the lower rope end 431 of the rope 43 when opening the umbrella as shown in FIG. 2, and an upper sleeve 47 having a lower sleeve end 471 slidably disposed around an upper sleeve end 462 of the middle sleeve 46 and an upper sleeve end 472 of the upper sleeve 47 connected with the inner block 15; the middle sleeve 46 and the upper sleeve 47 being slidably disposed within the opening spring 3.

The link holder 42 especially as shown in FIGS. 2, 7, 8, 9, 10 and 11 includes: a plug 421 made of elastomers such as polyvinyl choride, rubber, etc., secured on a lower link end 411 of the link 41 by a pin 422, and a washer 423 made of rigid materials such as steel or other rigid metals for reinforcing the strength of the plug 421.

The link holder 42 is fixed in a lower tube portion of the lower tube 11 by pressing the lower tube 11 inwardly to form at least a pair of lugs 110 retaining the plug 421 in the lower tube 11 (FIGS. 7, 8) or by inserting the pin 422 transversely through the lower tube 11 (FIG. 9).

When connecting the link 41 with the link holder 42, the lower link end 411 is flattened to pass through a central hole formed in the washer 423 to be inserted into the plug 421 and be fixed with the plug 421 by transversely inserting the pin 422 through the plug 421 and the lower link end 411, with the link holder 42 fixed in the lower portion of the lower tube 11.

The roller holder 451 for rotatably mounting the lower roller 45 thereon as shown in FIGS. 12–14 includes: a roller shaft 452 protruding inwardly from the roller holder 451 which is embedded into the socket 242 recessed in the lower runner 24, and at least a tenon 453 engaged in the tenon cavity **242*a* in the lower runner (FIG. 14 showing two tenons 453,454 respectively engaged with two tenon cavities 242*a*, 242*b* formed in the runner 24) for embedding the roller holder 451 into the socket 242 in the lower runner 24**.

The control means 5 includes: a push button 51 slidably held in a button hole formed in the grip 12 and having a protrusion 511 extending inwardly from the button 51, a control lever 52 pivotally mounted in the grip 12 by a pivot 521, a depression portion 522 formed on a middle portion of the lever 52 to be depressed by the protursion 511 of the button 51, a hook portion 523 formed on an upper end of the lever 52 for engaging the engaging holes 131, 141 respectively formed in the middle and upper tubes 13, 14 when closing the umbrella, and a restoring spring 524 retained in the grip 12 and normally urging the hook portion 523 outwardly beyond the lower tube 11 ready for engaging the engaging holes 131, 141 of the middle and upper tubes 13, 14 when closing the umbrella.

The link holder **42*a* as modified in FIG. 15 includes: a cylindrical plug 421*a* secured in a lower tube portion of the lower tube 11 by a pin 422, a vertical socket 424 longitudinally formed in the plug 421*a* for engaging a locking head 411*a* secured to the lower link end 411 of the link 41, and an elastic pawl 425 pressed inwardly from the cylindrical plug 421*a* for engaging the locking head 411*a* when downwardly inserted into the vertical socket 424**.

The opening spring 3 may have its lower spring end 31 retained on the washer 423 of the link holder 42 or having the lower spring end 31 retained on the lugs 110 as pressed from the tube 11.

Figure 10:
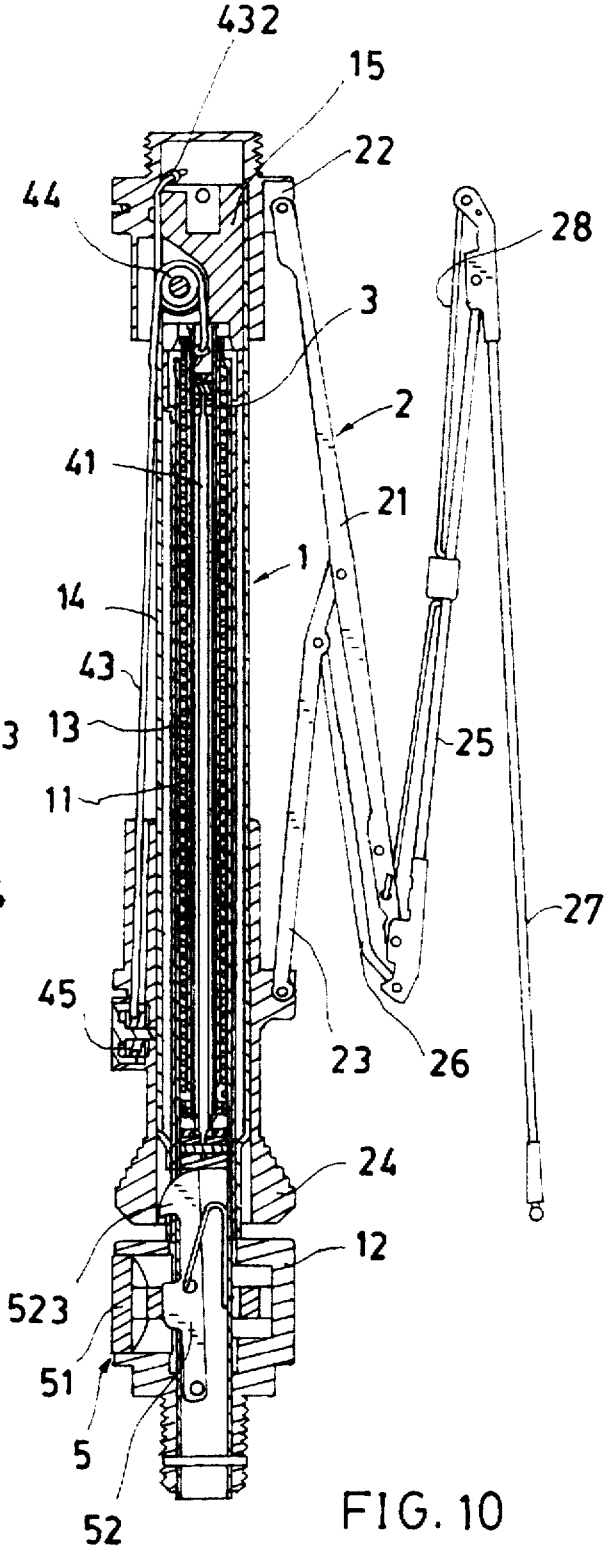
FIG. 10 shows a folded umbrella of the present invention.

When opening the umbrella of the present invention from FIG. 10 to FIG. 2, the push button 51 is depressed to push the lever 52 to disengage the hook portion 523 from the engaging holes 141, 131 of the upper and middle tubes 14, 13 and the opening spring 3 will extend the tubes 14, 13, 11 and the lower runner 24 will be pulled upwardly by the drag means 4 to extend the rib assembly 2 and open the umbrella cloth C.

When closing the umbrella, the skirt portion 241 of the lower runner 24 is pulled downwardly to retract the tubes 14, 13, 11 until the engaging holes 141, 131 of the upper and middle tubes 14, 13 are engaged with the hook portion 523 and the spring 3 is also compressed to store its resilience ready for next opening operation.

The present invention is superior to a conventional multiple-fold umbrella with the following advantages:

1. The tubes 14, 13, 11 are made of light aluminum alloy for convenient carrying. The tube has concave polygonal sides for reinforcing the tube strength for resisting deformation of the tubes. The spring catches for coupling the tubes have been omitted for saving cost.

2. When opening the umbrella, the lower runner 24 is pulled by the rope 43 and link 41 of the drag means 4 to smoothly open the umbrella cloth C, like a rear umbrella ejected from a jet plane when landing on a short runway on a carrier for a buffer for the great impact force of the jet, to thereby dampen the great spring force as effected by the opening spring 3 for preventing damage of the umbrella.

3. The link holder 42 includes the plug 421 made of elastomers which may serve as a shock absorber to absorb the shock caused during the opening or closing operation of the umbrella, and also to reinforce the strength of the lower tube 11 as packed within the lower tube; and the washer 423 which is provided for reinforcing the plug 421 and may be served for retaining the lower spring end 31 of the opening spring 3. The rigid washer 423 and the soft plug 421 may reinforce the strength of the light-weight umbrella of the present invention.

The present invention may be modified without departing from the spirit and scope of the present invention.

I claim:

1. A lightening multiple-fold automatic umbrella comprising:

a central shaft (1) having a lower tube (11), a middle tube (13) and an upper tube (14) telescopically engageable with one another, a grip (12) secured under the lower tube (11), and an inner block (15) fixed in an upper end portion of the upper tube (14); said central shaft (1) having said tubes made of light-weight materials and having at least a portion of said central shaft formed to have a cross section of concave hexagonal sides; an umbrella rib assembly (2) having at least a top rib (21) pivotally secured to an upper notch (22) formed on the upper end portion of the upper tube (14), and a stretcher rib (23) pivotally connected between the top rib (21) and a lower runner (24) slidably held on said central shaft (1);

an umbrella cloth (C) secured on said rib assembly (2);

an opening spring (3) retained between a lower portion of the lower tube (11) and the inner block (15) of the upper tube (14) for opening the umbrella;

a drag means (4) connected between the central shaft (1) and the lower runner (24) of the rib assembly (2) for pulling the lower runner (24) for extending the rib assembly (2) for opening the umbrella cloth (C) as urged by the opening spring (3) when opening the umbrella, said drag means (4) including: a link (41) having a lower link end (411) secured on a link holder (42) fixed in a lower portion of the lower tube (11), a rope (43) having a lower rope end (431) connected with an upper link end (412) of the link (41) and having an upper rope end (432) fixed into the inner block (15) on the upper tube (14) b winding the rope (43) through an upper roller (44) rotatable mounted on the inner block (15) and then deflected downwardly to be wound on a lower roller (45) rotatable mounted on the lower runner (24) and then to be terminated at the upper rope end (432), a middle sleeve (46) having a lower sleeve end (461) disposed around a joint between the upper link end (412) of the link (41) and the lower rope end (431) of the rope (43) when opening the umbrella, and an upper sleeve (47) having a lower sleeve end (471) slidably disposed around an upper sleeve end (462) of the middle sleeve (46) and an upper sleeve end (472) of the upper sleeve (47) connected with the inner block (15); the middle sleeve (46) and the upper sleeve (47) being slidably disposed within the opening spring (3); and a control means (5) provided in the grip (12) for the control of the opening of the umbrella, said control means (5) including: a push button (51) slidably held in a button hole formed in the grip (12) and having a protrusion (511) extending inwardly from the button (51), a control lever (52) pivotally mounted in the grip (12) by a pivot (521), a depression portion (522) formed on a middle portion of the lever (52) to be depressed by the protrusion (511) of the button (51), a hook portion (523) formed on an upper end of the lever (52) for engaging two engaging holes (131, 141) respectively formed in the middle and upper tubes (13, 14) when closing the umbrella, and a restoring spring (524) retained in the grip (12) and normally urging the hook portion (523) outwardly beyond the lower tube (11) ready for engaging the engaging holes (131, 141) of the middle and upper tubes (13, 14) when closing the umbrella;

the improvement which comprises:

said lower runner (24) including: a short sleeve (24) slidably held on the central shaft (1), a skirt portion (241) gradationally enlarged outwardly downwardly from the short sleeve (24) for pulling the skirt portion (241) downwardly when closing the umbrella, a socket (242) recessed in a middle portion of the lower runner (24) for embedding a roller holder (451) in the socket (242) for rotatable mounting said lower roller (45) in the roller holder (451), and a rope groove (243) longitudinally formed in the lower runner (24) for passing said rope (43) of the drag means (4) through the rose groove (243) to be wound on the lower roller (45) on the roller holder (451); and said roller holder (451) for rotatable mounting the lower roller (45) thereon including: a roller shaft (452) Protruding inwardly from the roller holder (451) which is embedded into the socket (242) recessed in the lower runner (24), and at least a tenon (453) engaged in a tenon cavity (**242*a*) in the lower runner (24**).

* * * * *